US008069847B2

(12) United States Patent
Blosser

(10) Patent No.: US 8,069,847 B2
(45) Date of Patent: Dec. 6, 2011

(54) LIMB POCKET SPACER

(75) Inventor: Ben Blosser, Richland, IN (US)

(73) Assignee: Bear Archery Incorporated, Evansville, IN (US)

( * ) Notice: Subject to any disclaimer, the term of this patent is extended or adjusted under 35 U.S.C. 154(b) by 502 days.

(21) Appl. No.: 12/060,567

(22) Filed: Apr. 1, 2008

(65) Prior Publication Data

US 2009/0241928 A1 Oct. 1, 2009

(51) Int. Cl.
*F41B 5/12* (2006.01)

(52) U.S. Cl. ..... 124/25.6; 124/23.1; 124/86; 124/88; 124/89

(58) Field of Classification Search ..... 124/23.1, 124/25.6, 86, 88, 89
See application file for complete search history.

(56) References Cited

U.S. PATENT DOCUMENTS

| | | | | | |
|---|---|---|---|---|---|
| 3,161,189 | A * | 12/1964 | Chessman | 124/23.1 |
| 4,574,766 | A * | 3/1986 | Izuta | 124/23.1 |
| 4,674,468 | A * | 6/1987 | Izuta | 124/23.1 |
| 5,172,679 | A * | 12/1992 | Mussack | 124/25.6 |
| 5,231,970 | A * | 8/1993 | Ploot et al. | 124/23.1 |
| 5,339,790 | A * | 8/1994 | Smith | 124/25.6 |
| 5,433,792 | A * | 7/1995 | Darlington | 124/25.6 |
| 5,464,001 | A * | 11/1995 | Peck | 124/25.6 |
| 5,487,373 | A * | 1/1996 | Smith | 124/23.1 |
| 5,507,270 | A * | 4/1996 | Smith | 124/23.1 |
| 5,515,836 | A * | 5/1996 | Martin et al. | 124/23.1 |
| 5,546,923 | A | 8/1996 | Duncan | |
| 5,720,267 | A * | 2/1998 | Walk | 124/23.1 |
| 5,722,380 | A * | 3/1998 | Land et al. | 124/25.6 |
| 6,024,076 | A * | 2/2000 | Laborde et al. | 124/23.1 |
| 6,244,259 | B1 * | 6/2001 | Adkins | 124/23.1 |
| 6,360,734 | B1 * | 3/2002 | Andrews | 124/23.1 |
| 6,470,870 | B1 * | 10/2002 | Schaar | 124/25.6 |
| 6,543,432 | B2 * | 4/2003 | Andrews et al. | 124/23.1 |
| 6,571,785 | B1 * | 6/2003 | Choma | 124/25 |
| 6,886,549 | B2 * | 5/2005 | McPherson | 124/23.1 |
| 6,941,937 | B2 * | 9/2005 | Wheeler | 124/23.1 |
| 7,025,051 | B1 * | 4/2006 | Gallops, Jr. | 124/23.1 |
| 7,308,890 | B1 * | 12/2007 | Wheeler | 124/23.1 |
| 7,334,575 | B2 * | 2/2008 | McPherson | 124/23.1 |
| 7,584,750 | B2 * | 9/2009 | Chang | 124/25 |
| 2003/0084893 | A1 * | 5/2003 | Andrews | 124/23.1 |
| 2005/0121012 | A1 * | 6/2005 | McPherson | 124/23.1 |
| 2008/0072888 | A1 * | 3/2008 | Chang | 124/25 |
| 2008/0127961 | A1 * | 6/2008 | McPherson | 124/88 |
| 2008/0156310 | A1 * | 7/2008 | Leven | 124/89 |
| 2008/0236557 | A1 * | 10/2008 | Budd | 124/25.6 |
| 2009/0071457 | A1 * | 3/2009 | Gordon et al. | 124/25.6 |
| 2009/0071458 | A1 * | 3/2009 | Gordon et al. | 124/25.6 |
| 2009/0145411 | A1 * | 6/2009 | Sims et al. | 124/25.6 |
| 2010/0263650 | A1 * | 10/2010 | Dahl et al. | 124/25.6 |

* cited by examiner

*Primary Examiner* — Gene Kim
*Assistant Examiner* — Alexander Niconovich
(74) *Attorney, Agent, or Firm* — Woodard, Emhardt, Moriarty, McNett & Henry LLP

(57) ABSTRACT

An archery bow comprises a riser portion with upper and lower ends, and at least one bow limb portion extending from the riser. The archery bow further includes at least one spacer member positioned between the riser portion and the bow limb portion, such that the limb portion contacts the spacer member. The spacer member has a longitudinal axis and a width axis, and includes at least one contact surface for contacting the limb portion with a bottom portion extending along the longitudinal axis underneath the contact surface. The contact surface extends beyond the bottom portion along the width axis to provide increased surface area contact with the bow limb portion.

19 Claims, 9 Drawing Sheets

LIMB POCKET SPACER

FIELD OF THE INVENTION

The present disclosure relates generally to archery bows and more particularly pertains to an improved limb pocket spacer for use in limb pockets of archery bows and a method for manufacturing the same.

BACKGROUND OF THE INVENTION

Compound archery bows generally including a bow frame having a handle or riser and two bow limbs (or four "quad" bow limbs), plus a cable system on the frame mounted to at least two rotational elements such as wheels. Archery bow limbs perform the important function of storing energy when the archer draws the bowstring. When the bowstring is drawn, the pre-stressed bow limbs, which are typically made of resilient material, are further flexed to store additional energy. When the bowstring is released, the stored energy propels the arrow. In conventional compound bows, each limb is typically formed of a single element with a rectangular cross section, where one end is attached to the bow handle and the other end has a limb tip slot formed therein, in which a rotational member such as a wheel, cam or pulley is mounted. In "quad" compound archery bows, two pairs of "quad" bow limbs are used, each having one end attached to the bow handle or riser and the other end coupled with the rotational member.

In certain archery bows, the ends or butt sections of the limbs are received and secured in limb pockets attached to ends of the riser. It is important for the limbs to be properly aligned with the riser and securely mounted to the riser to prevent movement of the limb ends. Fulcrums or spacers can be positioned within the limb pockets to contact portions of the archery bow limbs and move or rock with the bow limbs as they are flexed during use of the archery bow. To maintain the integrity of the archery bow limbs, it is helpful to provide sufficient contact surfaces on the spacer to sufficiently support the archery bow limbs. If the contact surfaces are not of sufficient size, the bow limbs are more likely to overstress and/or fail given flexion incurred by the limb during use of the archery bow. It is thus important to ensure that adequate contact area and engagement between the limb and the spacer is provided for.

There is a need for improved archery bow limb pocket spacers.

SUMMARY OF THE INVENTION

In one embodiment, an archery bow comprises a riser portion with an upper end and a lower end, and at least one bow limb portion having a butt section. The archery bow also includes at least one spacer member positioned between the riser portion and the bow limb portion such that the bow limb portion contacts the spacer member. The spacer member has a longitudinal axis and a width axis. Additionally, the spacer member includes at least one contact surface and a bottom portion extending along the longitudinal axis underneath the contact surface. The contact surface extends beyond the bottom portion to provide increased surface area contact with the quad bow limb members.

In another embodiment, an archery bow comprises a fulcrum member positionable within an archery bow limb pocket attachable to an archery bow riser. The fulcrum member includes a longitudinal axis and a width axis perpendicular to the longitudinal axis. Additionally, the fulcrum member includes at least one contact surface for contacting a portion of an archery bow limb and a part-rounded portion extending along the longitudinal axis underneath the contact surface. The part-rounded portion is configured to be received in a concave cavity of the archery bow limb pocket. The contact surface and the part-rounded portion each include a largest width along the width axis, the width of the contact surface being greater than the width of the part-rounded portion to increase the surface area contact with the archery bow limb.

In yet another embodiment, a flexible spacer member for use in an archery bow comprises a spacer member having a pair of contact portions for contacting a pair of archery bow limbs and a raised middle portion positioned between the pair of contact portions for separating the pair of archery bow limbs. The spacer member includes a rounded bottom surface defining a rounded bottom portion extending underneath the contact portions and the middle portion. Additionally, the contact portions each include a largest width generally parallel with the archery bow limbs and the middle portion includes a largest width, the widths of the contact portions each being greater than the width of the rounded bottom portion.

Other objects and attendant advantages of this disclosure will be readily appreciated as the same become more clearly understood by references to the following detailed description when considered in connection with the accompanying drawings in which like reference numerals designate like parts throughout the figures thereof.

DETAILED DESCRIPTION OF ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles of the disclosure being contemplated as would normally occur to one skilled in the art to which the disclosure relates.

The present disclosure is directed to limb pocket fulcrums or spacers for use in limb pockets of archery bows. A compound archery bow comprises a riser portion with an upper end and a lower end, with bow limbs attached to and extending from the riser, each limb having a butt, tip and hinge section. An archery bow often includes a pair of limb pockets coupled to the upper and lower ends of the riser portion and configured to receive the butt sections of the limbs. Additionally, the archery bow may comprise a pair of spacer members positioned within the limb pockets, such that portions of the limbs contact the spacer members. The spacer members of the present disclosure have a longitudinal axis and a width axis, and each includes at least one contact surface extending beyond a bottom part-rounded portion along the width axis to provide increased surface area contact with the bow limbs. Additionally, in embodiments having a "quad" compound archery bow, the spacer members each include pair of flexible wings having contact surfaces, with a raised limb separator positioned between the flexible wings along the longitudinal axis.

Figure 1:
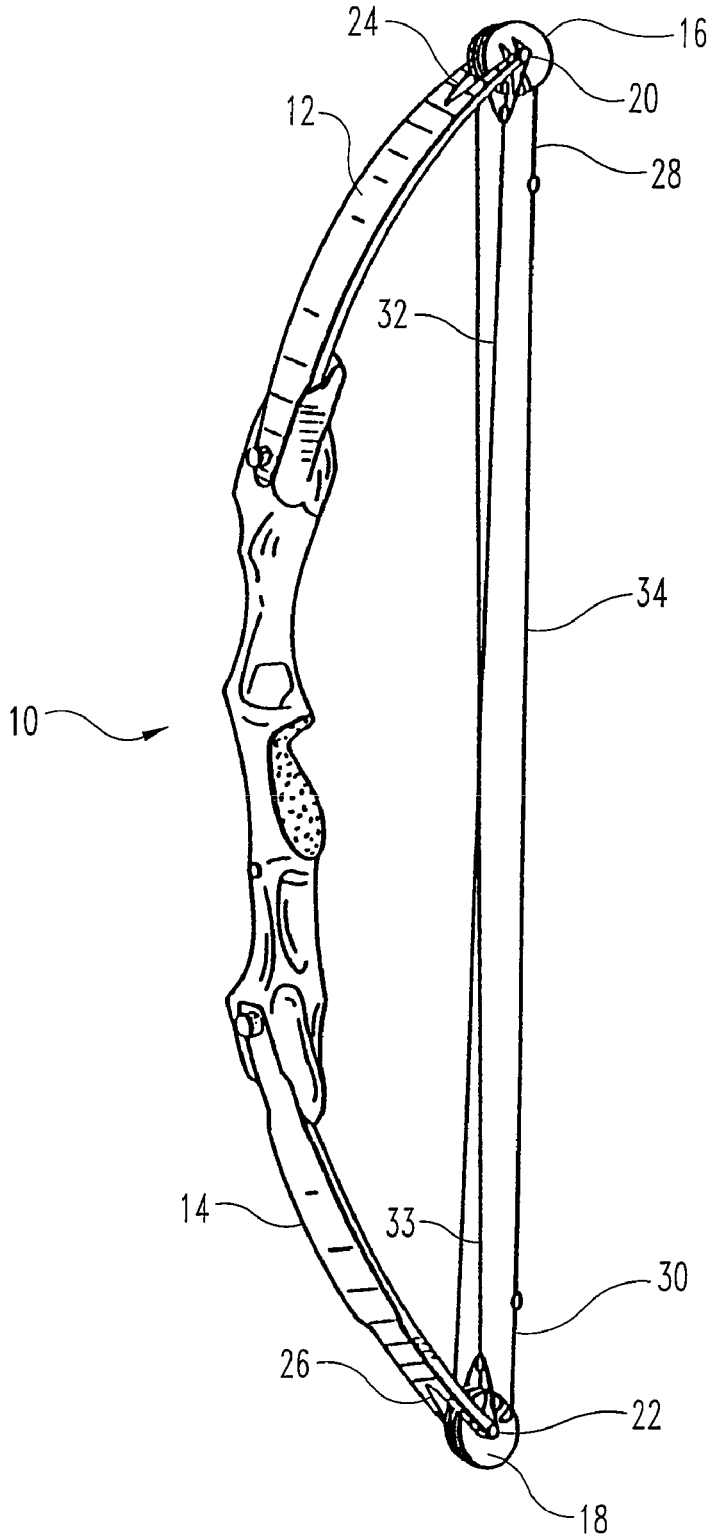
Fig. 1 (PRIOR ART)
FIG. 1 is a perspective view of a prior art compound archery bow.

FIG. 1 illustrates one example of a conventional dual-cam compound archery bow generally designated as 10. When viewed from the perspective of an archer holding the bow 10, it includes a handle with an upper limb portion 12 and a lower limb portion 14. Centrally disposed rotational members forming variable leverage units such as eccentric pulleys 16 and 18 are supported at the limb tip sections for rotary movement about axles 20 and 22. In the embodiment shown, the upper pulley axle 20 is carried in a slot between the outer limb tip portions 24 of upper limb 12. The lower pulley axle 22 is carried in a slot between the outer limb tip portions 26 of lower limb 14.

Bowstring 34 includes upper end 28 and lower end 30 which are fed-out from pulleys 16 and 18 when the bow is drawn. Bowstring 34 may be mounted around pulleys 16 and 18 as is known in the art. As illustrated, Y-yoke anchor cables 32 and 33 each preferably extend from one pulley to the axle of the other pulley.

Figure 3:
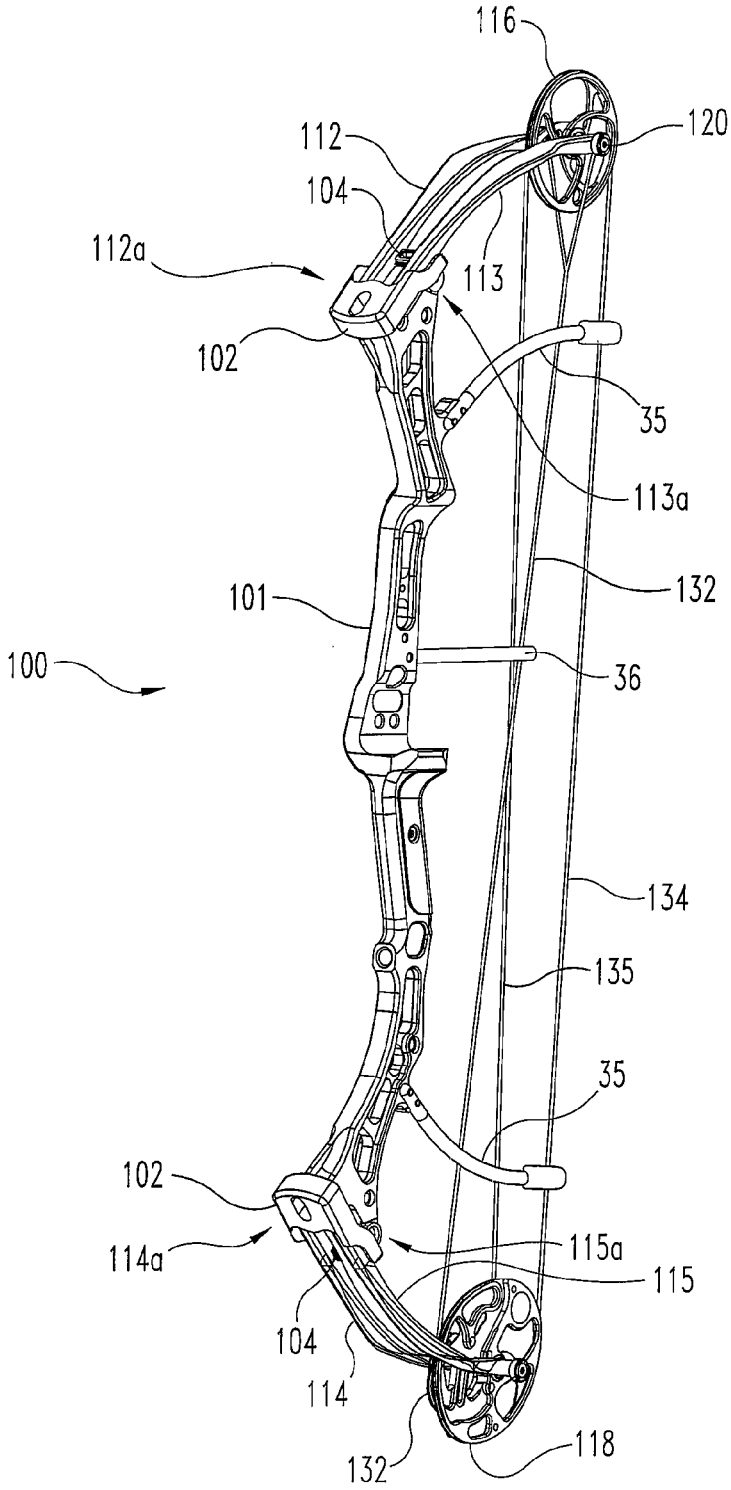
FIG. 3 is a perspective view of a compound archery bow according to one preferred embodiment of the present invention.

When the bowstring 34 is drawn, it causes eccentric pulleys 16 and 18 at each end of the bow to rotate, feeding out cable and bending limb portions 12 and 14 inward, causing additional energy to be stored therein. When the bowstring 34 is released with an arrow engaged to the bowstring, the limb portions 12 and 14 return to their rest position, causing the eccentric pulleys 16 and 18 to rotate in the opposite direction, to take up the bowstring 34 and launch the arrow with an amount of energy proportional to the energy initially stored in the bow limbs. Bow 10 is described for illustration and context and is not intended to be limiting. The present invention can be used with dual-cam compound bows, or can be used with single-cam bows as illustrated in FIG. 3 and as described for example in U.S. Pat. No. 5,368,006 to McPherson. The present invention can also be used in other types of bows, which are considered conventional for purposes of the present invention.

Figure 2:
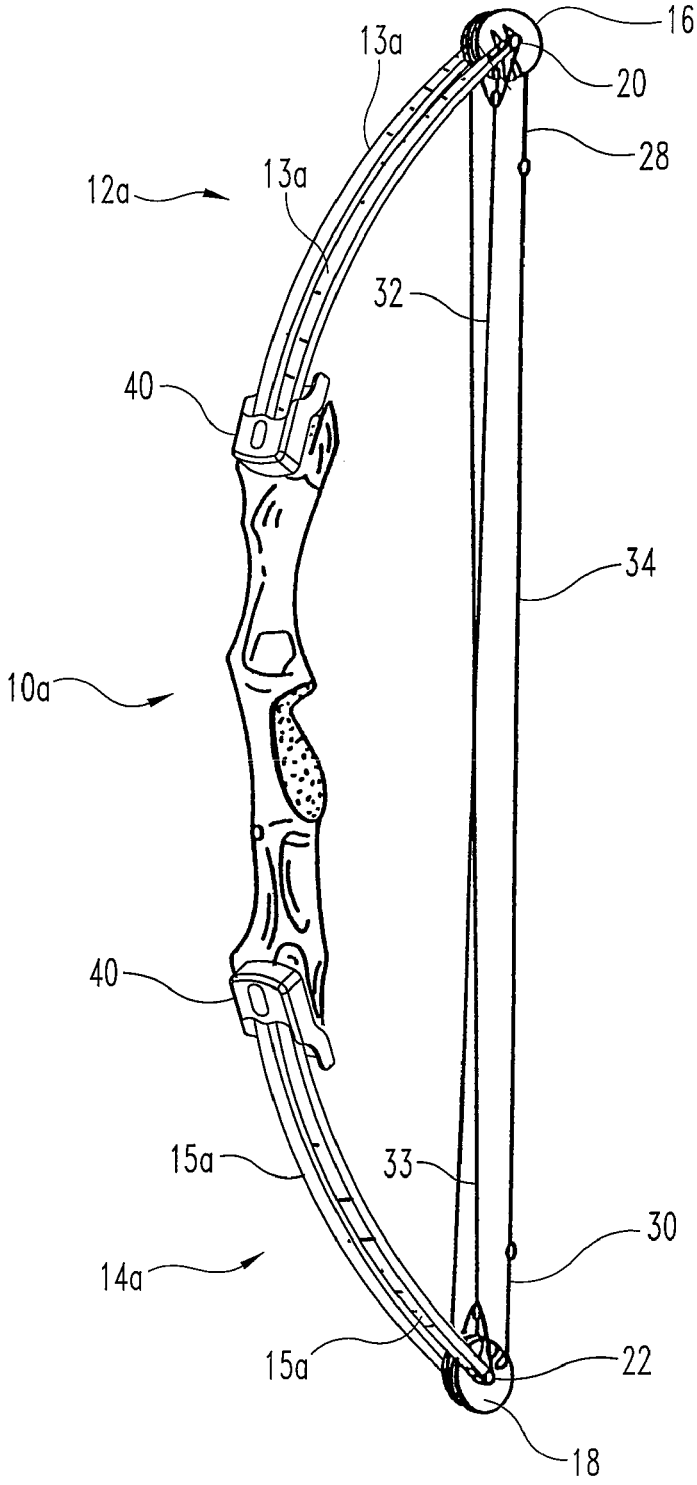
Fig. 2 (PRIOR ART)
FIG. 2 is a perspective view of another prior art compound archery bow.

FIG. 2 illustrates one example of a "quad" dual-cam compound archery bow generally designated as 10*a*. When viewed from the perspective of an archer holding the bow 10*a*, it includes a handle with an upper limb portion 12*a* and a lower limb portion 14*a*. Bow 10*a* also includes limb pockets 40 attached to ends of the handle to receive ends or butt sections of the limb portions. Similar to bow 10, centrally disposed rotational members forming variable leverage units such as eccentric pulleys 16 and 18 are supported at the limb tip sections for rotary movement about axles 20 and 22. In typical "quad" bows, limb portions 12*a* and 14*a* each include two parallel and symmetric "quad" limbs 13*a* and 15*a*, respectively. The illustrated quad limbs are separate members; however, it should be appreciated that in other embodiments the quad limbs may be connected to each other in one or more places. In the illustrated embodiment, the upper pulley axle 20 is carried between the limb tip sections of quad limbs 13*a* and the lower pulley axle 22 is carried between the limb tip sections of quad limbs 15*a*. Bow 10*a* includes bowstring 34 and anchor cables 32 and 33, as described above, and operates substantially in the same manner as described in connection with bow 10.

FIG. 3 illustrates an embodiment of the present disclosure with, for example, a "quad" single-cam compound archery bow generally designated as 100. The illustrated bow 100 includes a handle or riser 101 with an upper left quad limb 112, an upper right quad limb 113, a lower left quad limb 114, and a lower right quad limb 115 extending therefrom. In the illustrated embodiment, the limbs are configured such that they receive upper idler wheel 118 between the right and left upper limbs and lower cam 116 between the right and left lower limbs. In the illustrated embodiment, quad limbs 112-115 include flared portions along the length of the limbs. However, it should be appreciated, that the limbs could be sized and configured differently as would occur to one skilled in the art. In the illustrated embodiment, quad limbs 112 and 113 are mirror images, as are quad limbs 114 and 115. Additionally, as illustrated, quad limb 112 is substantially identical to quad limb 115, and quad limb 113 is substantially identical to quad limb 114. The wheels, pulleys and cabling of single-cam bow 100 may be conventional. In the illustrated embodiment, bowstring 134 extends between wheel 116 and cam 118, with portion 135 extending from the wheel 116 down to cam 118. A y-yoke anchor cable 132 extends from cam 118 up to the axle of wheel 116. Optionally, bow 100 may include dampening rods 35 and a cable guard rod 36, as illustrated.

Bow 100 may also include limb pockets 102 attached to the upper and lower ends of riser 101. Pockets 102 are configured to receive butt sections 112*a*-115*a* of quad limbs 112-115 to secure the limbs to the riser. Pockets 102 may be conventional. Positioned within pockets 102 are fulcrums or spacers 104, as will be described in greater detail below. Spacers 104 are configured to contact portions of the bow limbs, and may be configured to at least slightly rotate or rock within the limb pocket corresponding to flexion of the bow limbs during use of the archery bow. In the illustrated embodiment, spacers 104 are used in conjunction with a "quad" archery bow having four total quad bow limbs, with each spacer contacting two quad bow limbs. Accordingly, spacer 104 is also configured to separate the two corresponding quad bow limbs. However, it should be appreciated that in other embodiments, each spacer or fulcrum could be used with an archery bow having single bow limbs at each end, such a spacer being illustrated in FIG. 12 and discussed in greater detail below.

Figure 4:
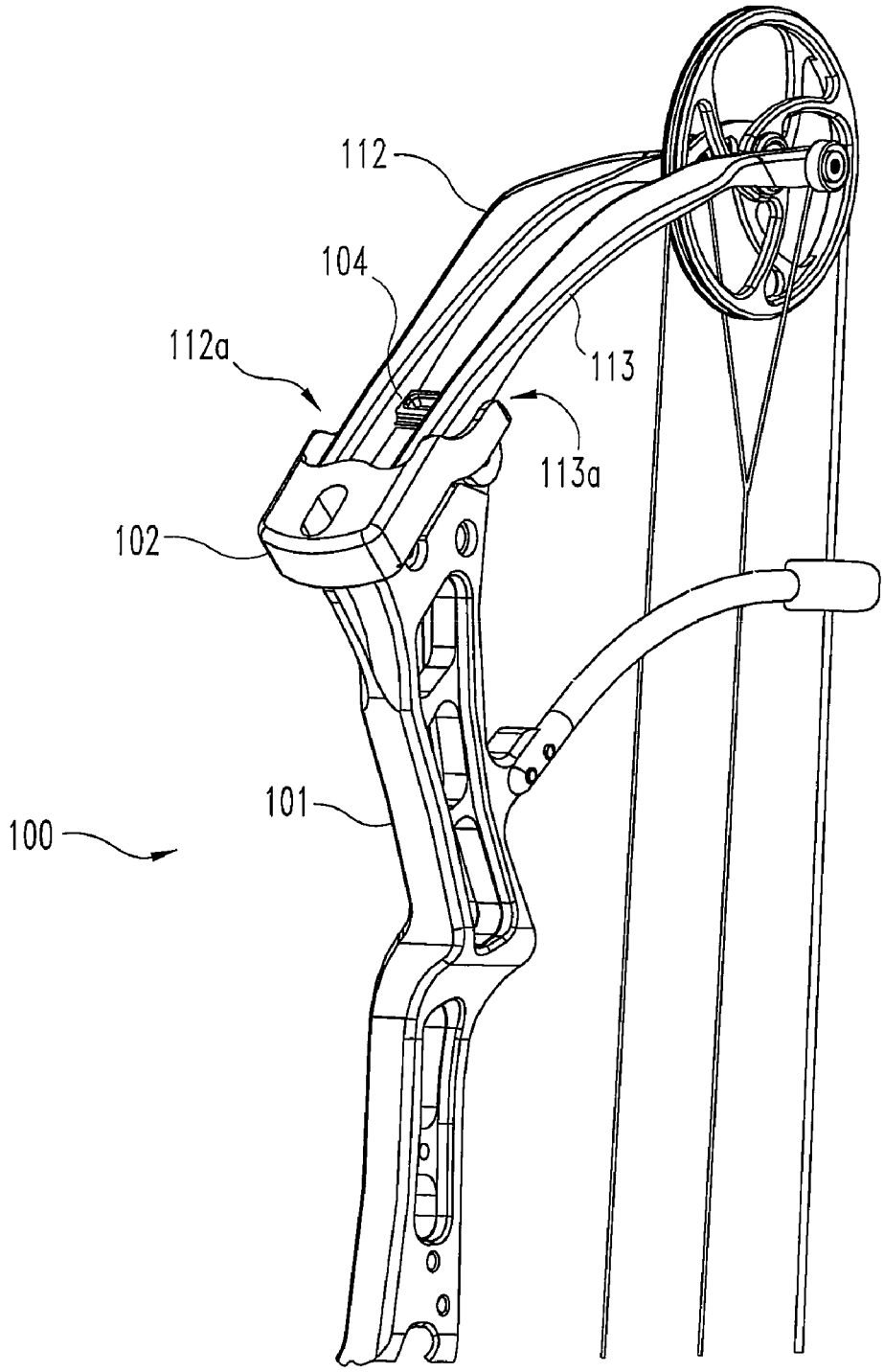
FIG. 4 is another perspective view of components of the compound archery bow according to the embodiment of FIG. 3.
Figure 5:
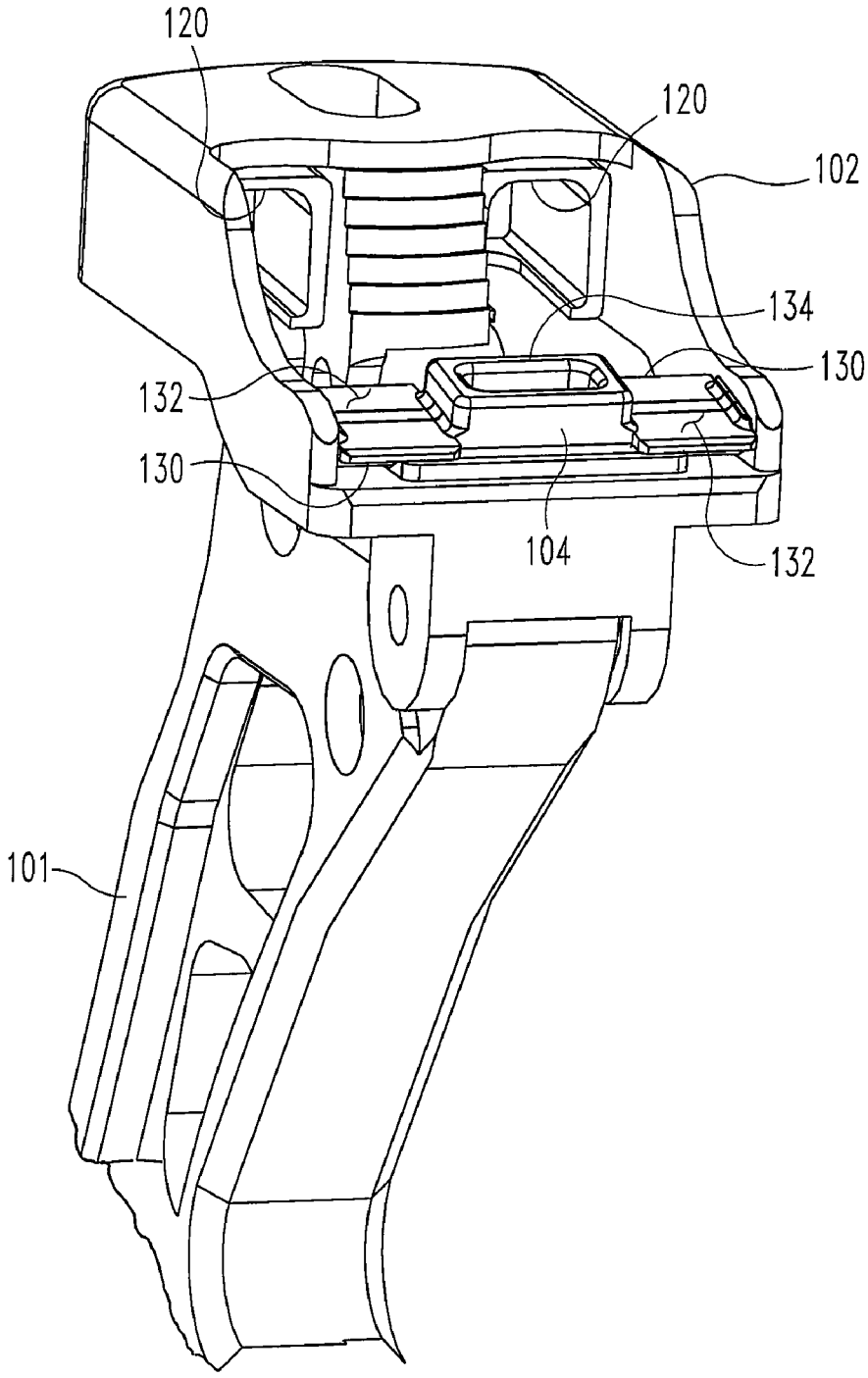
FIG. 5 is another perspective view of components of the compound archery bow according to the embodiment of FIG. 3.

FIGS. 4-5 illustrate a spacer 104 positioned with a limb pocket 102. In the illustrated embodiment, spacer 104 rests (or is loosely fitted) within limb pocket 102. As best illustrated in FIG. 5, butt sections of the quad limbs may be received and secured within boots 120 within limb pocket 102. However, it is contemplated that the quad limbs may be positioned and secured within limb pocket 102 in various other manners as would occur to one of ordinary skill in the art. It is also contemplated that in alternative embodiments the limb pockets are absent and the spacer members are directly coupled to ends of the riser. Spacer 104 generally includes a pair of contact portions or wing portions or wings 130 having contact surfaces 132, with a middle portion or raised limb separator 134 positioned between wings 130 (see FIG. 5). Portions of the lower face of the butt sections of the quad limbs are configured to contact or rest on the contact surfaces of the spacer, being separated by the raised limb separator.

Figure 6:
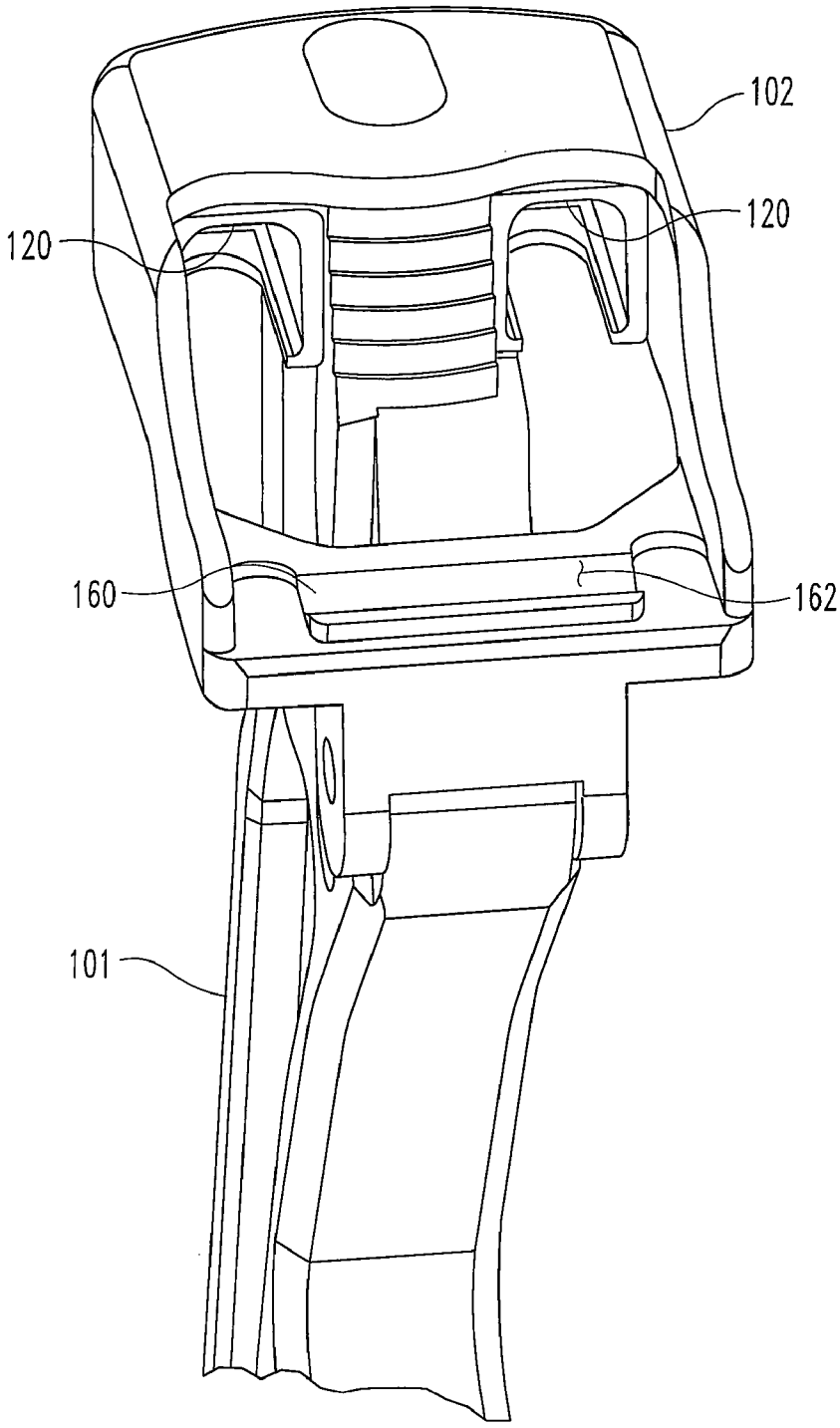
FIG. 6 is another perspective view of components of the compound archery bow according to the embodiment of FIG. 3.

FIG. 6 illustrates limb pocket 102, with spacer 104 removed. As illustrated, limb pocket 102 includes a seat 160 defining a concave, rounded surface 162 configured to receive the bottom part-rounded portion of spacer 104 (see FIG. 7). In certain embodiments, the configuration and radius of curvature of concave surface 162 matches the configuration and radius of curvature of the convex bottom surface of spacer 104. Spacer 104 is configured to rotate or rock within spacer 104 via the mating concave/convex surfaces in response to movement of the bow limbs during use of archery bow 100.

The specific geometry of the illustrated spacer 104 will be discussed generally with reference to the various views illustrated in FIGS. 7-11. Spacer 104 includes a length $L_S$ along a longitudinal axis L. As illustrated, spacer 104 includes a convex curved or rounded bottom surface 142 defining a part-rounded portion 140 extending along the length $L_S$ of spacer 104 underneath wings 130 and raised limb separator 134. Part-rounded portion 140 is configured to sit within seat 160 of limb pocket 104, such that concave surface 162 mates with convex surface 142 to allow for at least slight rotational or rocking movement of spacer 104 within limb pocket 102. The rotational or rocking movement of spacer 104 corresponds to movement of the bow limbs as the bow string is drawn and released during use of the archery bow.

Figure 7:
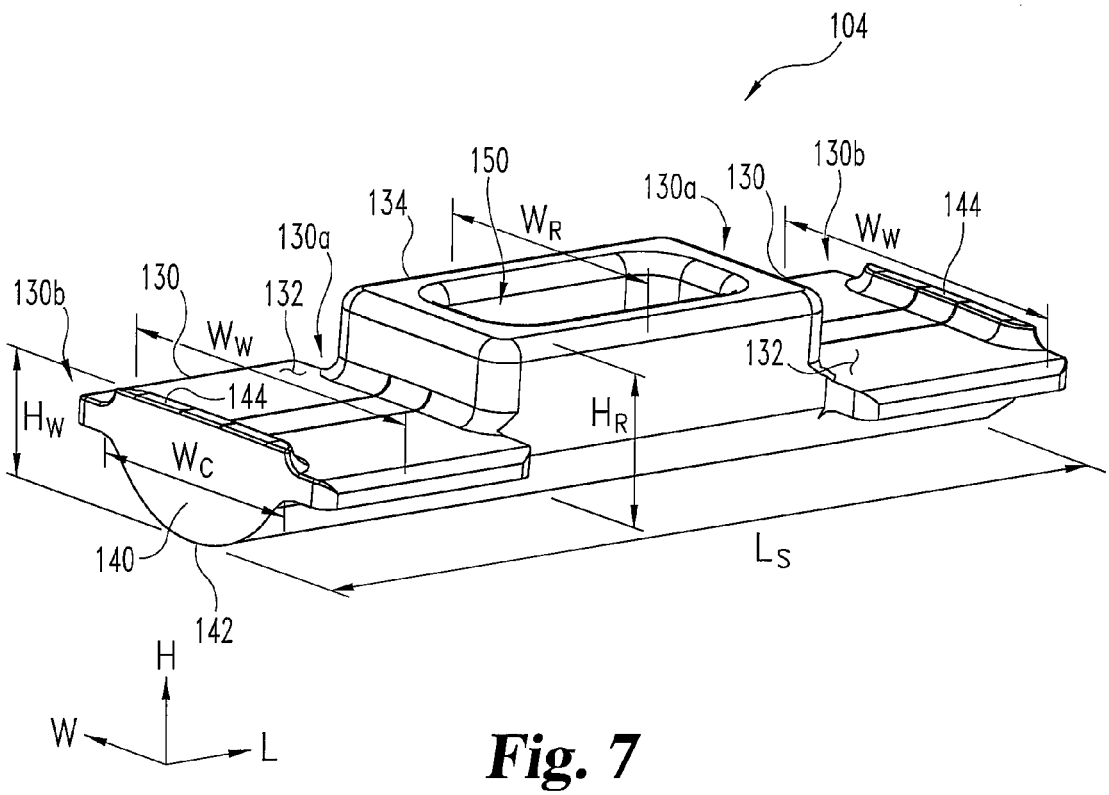
FIG. 7 is a perspective view of the limb pocket spacer of the compound archery bow according to the embodiment of FIG. 3.
Figure 8:
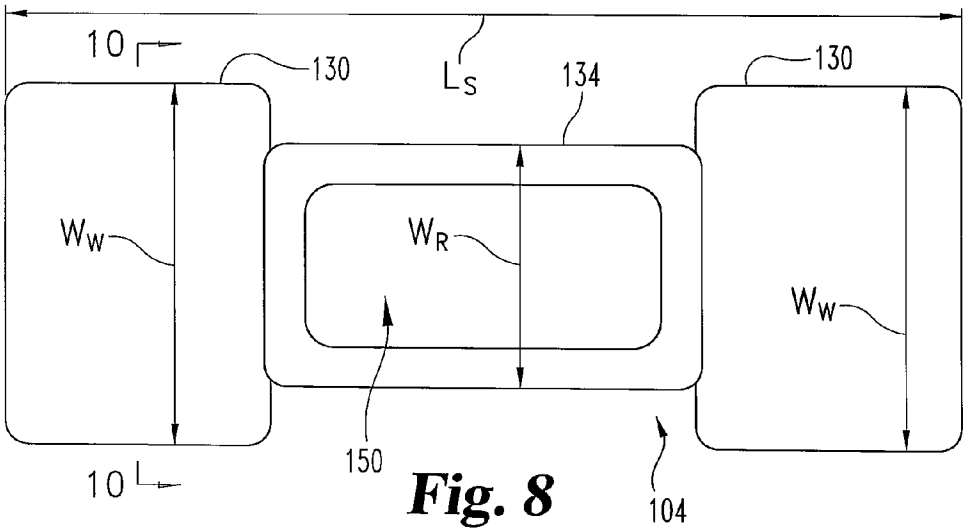
FIG. 8 is a top view of the limb pocket spacer of the compound archery bow according to the embodiment of FIG. 3.
Figure 10:
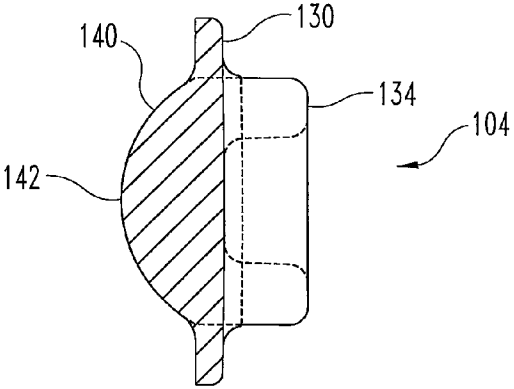
FIG. 10 is a side view of the limb pocket spacer of the compound archery bow according to the embodiment of FIG. 3.
Figure 9:
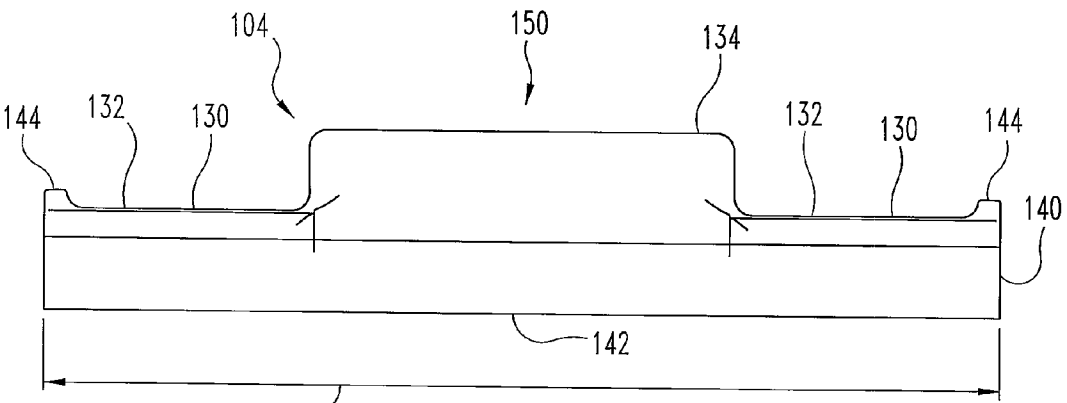
FIG. 9 is a front view of the limb pocket spacer of the compound archery bow according to the embodiment of FIG. 3.
Figure 11:
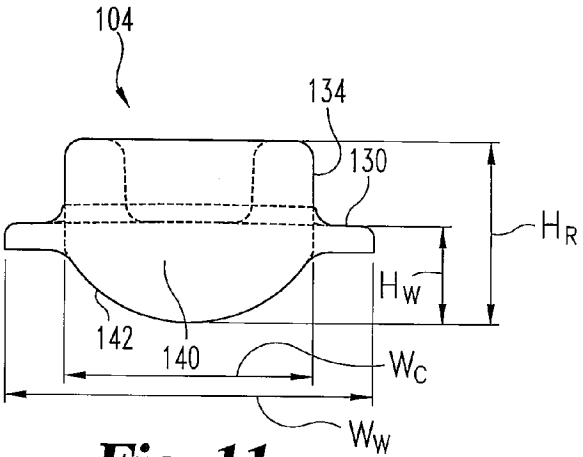
FIG. 11 is a partial cross-sectional, side view of the limb pocket spacer of the compound archery bow according to the embodiment of FIG. 3.

Points along curved surface 142 at the top of part-rounded portion 140 define a chord across the top of the part-rounded portion being the illustrated width $W_C$. In other words, part-rounded portion 140 defines a largest $W_C$ along width axis W. Wings 130 each include a width $W_W$ along a width axis W, and raised limb separator 134 includes a width $W_R$ along width axis W. In preferred embodiments, portions of wings 130 with contact surfaces 132 extend beyond part-rounded portion 140 along width axis W, such that the widths $W_W$ of wings 130 are each larger than width $W_C$ of part-rounded portion 140 (as best illustrated in FIGS. 7 and 11). In the illustrated embodiment, wings 130 with contact surfaces 132 also extend beyond limb separator 134 along width axis W. The extended widths of wings 130 with contact surfaces 132 allow for increased surface area contact with the bow limbs which contact spacer 104, and thus increased area for stress distribution along contact surfaces 132 during use of bow 100, allowing the spacer to provide increased support to the limbs during flexion thereof and assist in preventing overstress and failure of the bow limbs. In the illustrated embodiment, width $W_C$ of part-rounded portion 140 is equal to or substantially the same as width $W_R$ of raised limb separator 134.

In the illustrated embodiment (see FIGS. 10 and 11), the cross-sectional shape of spacer 104 is part-circular along bottom surface 142 corresponding to part-rounded portion 140. In certain embodiments, bottom surface 142 includes a constant radius of curvature such that part-rounded portion 140 is part-cylindrical. In certain other embodiments, bottom surface 142 is comprised of two or more varying radii of curvature. It should be appreciated that bottom surface 142 may have a different radius (or radii) of curvature than as illustrated, as would occur to one of ordinary skill in the art. Additionally, in certain embodiments, part-rounded portion 140 may be half-cylindrical. In certain other embodiments, portion 140 may be a greater or less segment of a cylinder (or other rounded shape) as would occur to one skilled in the art. In alternative embodiments, the bottom portion of the spacer may be square or rectangular in shape, being defined by flat, non-rounded surfaces.

Additionally, as best illustrated in FIGS. 7 and 11, wings 130 each include a height $H_W$ along a height axis H and raised limb separator 134 includes a height $H_R$ along height axis H. In preferred embodiments, height $H_R$ is larger than height $H_W$ such that raised limb separator 134 extends above contact surfaces 132 of wings 130 in order to maintain separation of the pair of bow limbs contacting spacer 104. In the illustrations shown in FIGS. 7 and 11, the heights of the wings and the raised limb separator are measured from the bottom of the spacer. However, it should be appreciated that the heights could be measured from other locations. Optionally, spacer 104 may also include walls 144 extending up and generally perpendicular to contact surfaces 132 at distal ends **130*b* of wings 130 (proximal ends 130*a* being adjacent raised limb separator 134). In such embodiments, walls 144 assist in maintaining the positioning of the bow limbs on contact surfaces 132 between walls 144 and raised limb separator 134. In the illustrated embodiment, walls 144 extend relatively slightly above contact surfaces 132; however, it should be appreciated that walls 144, if present, can extend a greater or lesser distance above the contact surfaces. In other embodiments, walls 144** may be absent.

Figure 12:
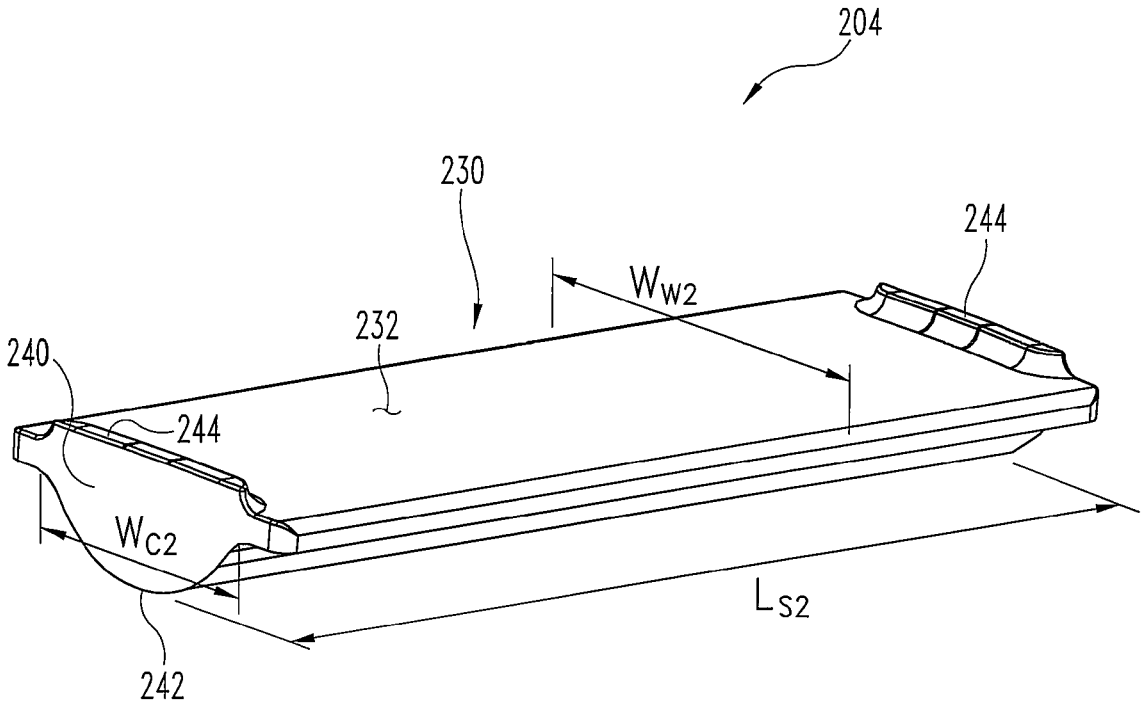
FIG. 12 is a perspective view of a limb pocket spacer according to another embodiment.

FIG. 12 illustrates a spacer 204 configured for use in an archery bow having single limb members extending from the riser or handle. Spacer 240 has a length axis $L_2$ and a width axis $W_2$, and includes a single wing 230 having a contact surface 232 for contact with a single archery bow limb member. Spacer 204 includes a length $L_{S2}$ along longitudinal axis $L_2$. Similar to portion 140 of spacer 104, spacer 204 includes a convex curved or rounded bottom surface 242 defining a part-rounded portion 1240 extending along the length $L_{S2}$ of spacer 204 underneath wing 230. Part-rounded portion 140 is configured to rotate or rock within a convex seat of a limb pocket, corresponding to movement of the bow limb during use of the archery bow.

Wing 230 with contact surface 232 includes a width $W_{W2}$ along width axis $W_2$ and part-rounded portion 240 includes a width $W_{C2}$ along width axis $W_2$, with width $W_{C2}$ being larger than $W_{W2}$ such that contact surface 232 extends beyond part-rounded portion 240 along the width axis to allow for increased surface area contact with the bow limb which contacts spacer 204. Similar to part-rounded portion 140, portion 240 may also be part-cylindrical with surface 242 having a constant radius of curvature. However, it should be appreciated that portion 240 may be configured differently as would occur to one skilled in the art.

Optionally, spacer 204 may also include walls 244 extending up and generally perpendicular to contact surface 232 at ends thereof. In such embodiments, walls 244 assist in maintaining the positioning of the bow limb on contact surface 232 between the walls. In the illustrated embodiment, walls 144 extend relatively slightly above contact surface 232; however, it should be appreciated that walls 244, if present, can extend a greater or lesser distance above the contact surfaces. In other embodiments, walls 244 may be absent.

Spacers 104 and/or 204 are preferably at least slightly flexible and/or compressible to accommodate the varying radius of the bow limbs as they flex during use of the archery bow. Additionally, spacers 104 and/or 204 may be composed of one or more of a variety of appropriate materials, for examples including a plastic or rubber. In certain embodiments, spacers 104 and/or 204 may be composed of a nylon material. It is contemplated that spacers 104 and/or 204 may be formed using an injection molding process involving a mold assembly shaped and configured to form the spacers. In certain embodiments, the material is heated in the mold assembly and then cured by being placed in an oven and heated at a desired temperature. If necessary, final machining may be done to complete the forming process. In certain other embodiments, it is contemplated that spacers 104 and/or 204 may be formed by other appropriate manners. In the illustrated embodiment, a plurality of the corners within the spacers include radiused corner profiles. These are provided to avoid having to machine grind or cut stress-inducing sharp corners. In such embodiments, the radius corner profiles may be formed by molding in the radius via a mold assembly. However, it should be appreciated that there could be greater or fewer radius corner profiles than as illustrated. In other embodiments, radius corner profiles are absent from the spacers.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed is:

1. An archery bow, comprising:

a. a riser portion with an upper end and a lower end;

b. at least one pair of quad bow limb members, each of said members having a butt section;

c. at least one spacer member positioned between said riser portion and said quad bow limb members such that said quad bow limb members contact said spacer member, said spacer member having a longitudinal axis and a width axis, wherein said spacer member includes a pair of flexible wings and a rounded bottom portion extending along the longitudinal axis underneath said wings, each of said wings having a contact surface with a width, wherein each of said contact surface widths extends beyond the largest width of said rounded bottom portion along the width axis to provide increased surface area contact with said bow limb members; and d. at least one limb pocket coupled to one of said upper and lower ends of said riser portion, wherein said limb pocket has a butt end defining at least one boot to receive said butt sections of said quad bow limb members, and wherein said spacer member is spaced along said limb pocket outward of said boot and adjacent an opposite end of said limb pocket from said butt end.

2. The archery bow of claim 1, wherein said spacer member includes a raised limb separator positioned between said wings along the longitudinal axis to separate said quad bow limb members.

3. The archery bow of claim 2, wherein each of said wings includes a proximal end adjacent said raised limb separator and an opposite distal end along the longitudinal axis, wherein said distal ends include upwardly extending walls configured to maintain positioning of portions of said quad bow limb members on said contact surfaces between said walls and said raised limb separator.

4. The archery bow of claim 1, wherein each of said wings extends beyond said rounded bottom portion substantially equal distances in both directions along the width axis.

5. The archery bow of claim 1, wherein said spacer member defines front and back lower edges where said rounded bottom portion meets said wings, wherein each of said wings extends beyond both of said front and back lower edges along the width axis.

6. The archery bow of claim 1, wherein each of said contact surfaces includes front and back edges, and wherein each of said quad bow limb members extends beyond both of said front and back edges of said corresponding contact surface.

7. The archery bow of claim 1, wherein said limb pocket defines a concave seat configured to receive said rounded bottom portion, said concave seat having front and back edges and being spaced along said limb pocket outward of said boot, wherein each of said wings extends beyond both of said front and back edges of said concave seat along the width axis.

8. An archery bow, comprising, a fulcrum member positionable within an archery bow limb pocket attachable to an archery bow riser, wherein said fulcrum member includes a longitudinal axis and a width axis perpendicular to the longitudinal axis, wherein said fulcrum member includes at least one contact surface configured for contacting a lower face of an archery bow limb which extends the length of the bow limb, the archery bow limb being positioned parallel to the width axis of said fulcrum member, wherein said fulcrum member includes a part-rounded portion extending along the longitudinal axis underneath said contact surface configured to be received in a concave cavity of the archery bow limb pocket, wherein said contact surface and said part-rounded portion each include a largest width along the width axis parallel to the archery bow limb, wherein said largest width of said contact surface is greater than said largest width of said part-rounded portion to increase the surface area contact with the archery bow limb; wherein said at least one contact surface includes a pair of contact surfaces for contacting a pair of quad bow limbs, wherein said fulcrum member further includes a limb separator positioned between said contact surfaces along the longitudinal axis, wherein said limb separator is raised above said contact surfaces to separate the pair of quad bow limbs contacting said contact surfaces.

9. The archery bow of claim 8, wherein said contact surfaces, said limb separator, and said part-rounded portion are integrally formed together as said fulcrum member.

10. The archery bow of claim 8, wherein said width of said part-rounded portion is substantially equal to the width of said limb separator.

11. The archery bow of claim 8, wherein said fulcrum member includes walls extending up from said contact surfaces such that the quad bow limbs are positioned on said contact surfaces between said walls and said limb separator.

12. The archery bow of claim 8, wherein said fulcrum member is at least slightly flexible.

13. The archery bow of claim 8, wherein said archery bow limb pocket has a butt end defining at least one boot to receive a butt section of the archery bow limb, and wherein said fulcrum member is spaced along said limb pocket outward of said boot and adjacent an opposite end of said limb pocket from said butt end.

14. The archery bow of claim 8, wherein said contact surface extends beyond said part-rounded portion substantially equal distances in both directions along the width axis.

15. The archery bow of claim 8, wherein said part-rounded portion has a centerline extending along the longitudinal axis, wherein said contact surface extends substantially equal distances from the centerline in both direction along the width axis.

16. A flexible spacer member for use in an archery bow, comprising:

a spacer member configured to be placed between a pair of archery bow limbs and an archery bow limb pocket, said spacer member having a pair of contact surfaces for contacting bow limb lower faces which extend the length of the pair of archery bow limbs, and having a raised middle portion on said member positioned between said pair of contact surfaces for separating the pair of archery bow limbs;

wherein said spacer member includes a rounded bottom surface defining a rounded bottom portion extending underneath said contact surfaces and said middle portion; wherein said contact surfaces each include a largest width along a width axis generally parallel with the archery bow limbs and said rounded bottom portion includes a largest width, wherein said largest widths of said contact surfaces are each greater than said largest width of said rounded bottom portion.

17. The spacer member of claim 16, wherein said spacer member includes side walls generally perpendicular to said contact surfaces to maintain positioning of the archery bow limbs between said side walls and said middle portion.

18. The spacer member of claim 16, wherein said contact surfaces, said middle portion, and said rounded bottom portion are integrally formed together as said spacer member.

19. The spacer member of claim 16, wherein said contact surfaces extend beyond said rounded bottom portion substantially equal distances in both directions along the width axis.

* * * * *